United States Patent [19]

Kroeze et al.

[11] 3,938,674

[45] Feb. 17, 1976

[54] METHOD AND APPARATUS FOR STACKING PAPERBOARD BLANKS

[75] Inventors: Hendrik J. Kroeze, Albergen; Hans Scheij, Almelo, both of Netherlands

[73] Assignee: Koppers Company, Inc., Pittsburgh, Pa.

[22] Filed: Sept. 9, 1974

[21] Appl. No.: 504,226

[52] U.S. Cl. ..... 214/6 G; 214/6 H; 271/69; 271/201; 271/216

[51] Int. Cl.[2] ..... B65G 57/112; B65H 29/22

[58] Field of Search ..... 214/6 G, 6 D, 6 H, 6 M, 214/152; 271/64, 69, 201, 202, 203, 216, 227, 242, 265

[56] References Cited

UNITED STATES PATENTS

| | | | |
|---|---|---|---|
| 2,272,045 | 2/1942 | Dudley | 271/242 |
| 2,660,432 | 11/1953 | Wilske et al. | 214/6 G X |
| 2,789,709 | 4/1957 | Shields | 214/6 H |
| 2,951,575 | 9/1960 | Gordon et al. | 214/6 D X |
| 3,084,812 | 4/1963 | Johansson | 214/6 H X |
| 3,527,460 | 9/1970 | Lopez | 214/6 G X |
| 3,643,940 | 2/1972 | Lopez | 271/202 |
| 3,756,591 | 9/1973 | Müller | 271/69 |
| 3,791,269 | 2/1974 | Sawada | 271/202 X |

*Primary Examiner*—Robert J. Spar
*Assistant Examiner*—Leslie J. Paperner
*Attorney, Agent, or Firm*—Oscar B. Brumback; Boyce C. Dent

[57] ABSTRACT

A method of stacking corrugated paperboard blanks issuing from a corrugator that produces parallel streams of blanks from an advancing endless web by shingling the blanks from each of the streams and advancing them to lineally displaced stacking stations where a predetermined number of blanks are accumulated and then interrupting the flows of blanks for removing stacks of blanks from the stacking stations. Suitable apparatus for performing the method includes vertically displaced, parallel shingling conveyors which advance the shingled blanks to lineally displaced stacking platforms and a gating apparatus at the downstream end of each conveyor to interrupt the flow of blanks while the stacks are removed from the platforms. The output end of the lower conveyor rises to compensate for the increasing height of the stack on its associated platform while the other platform falls to similarly compensate for the increasing height of the stack thereon. The input end of each conveyor falls beneath the level of incoming blanks while the conveyors are stopped during removal of the stacks so that storage stacks are temporarily formed on the conveyors until they resume advancement of the blanks to the stacking platforms. The apparatus preferably includes an accumulator stacker laterally aligned with the lower stacking platform for forming final stacks of blanks consisting of smaller stacks removed from the lower platform.

6 Claims, 7 Drawing Figures

METHOD AND APPARATUS FOR STACKING PAPERBOARD BLANKS

BACKGROUND OF THE INVENTION

1. Field of the Invention

This invention relates generally to sheet delivering and more particularly to endless conveyor transport and stacking methods and apparatus.

2. Description of the Prior Art

A corrugated blank production machine or corrugator produces, in the first instance, an endless strip or web of corrugated board. Such corrugators cut endless strips of corrugated board by way of circular blades. This results in endless strips of corrugated board, running side by side, without any space between them. The cutting device of the corrugator usually has one circular cut-off knife whereby such endless strips of corrugated board are cut width-wise to various selected lengths. As a rule, this arrangement consists of at least one separate cut-off unit. Whenever there is more than one cut-off unit attached to the corrugator machine, then one of the units is placed higher than the other. A part of the former endless, but lengthwise cut corrugated strip, is brought to the upper knife while the other half is brought to the lower knife. Both knives can cut independently of each other to an adjustable length.

The result, therefore, is that a corrugator produces a stream of endless sheets or blanks. The sheets can be discharged as a single flow of sheets from the lower knife and a single flow from the upper knife or as a single flow from the upper or lower knives.

The continuous flow of sheets of board which are produced by the corrugator have to be received. For this purpose there are existing semi-automatic and fully automatic stacking machines. With the semi-automatic machines, stacks of blanks about 100 mm in height are formed, and these are carried off sideways (or indirectly) and further stacks are formed by way of manual labor. The fully automatic machine forms stacks of about 1800 mm high directly from the lower as well as the upper knife.

The biggest drawback of existing fully automatic machines is that the stacks of blanks are not precisely formed. That is to say, each blank is not stacked precisely above the blank below. Difficulty arises especially when the stacks are placed side by side. That is, the stacks catch or grip into each other, making it difficult to separate them. The forming of a new stack directly after a previously formed stack causes the most difficulty.

The corrugator machine continuously produces a stream of blanks and the receiving machine has to take care of temporary storage while stacks of the blanks are removed. Temporary storage is now taken care of by a machine which has a gate extending the full width of the machine. By closing the gate, the on-coming blanks are held up temporarily. During this temporary holdup, the blanks do not stay precisely aligned but extend randomly from side to side. When the previously formed stack is carried off, the gate opens and the blanks held in temporary storage become the lower half of the new stack. If the temporary stack being held up in front of the closed gate is imprecisely formed, then the new stack becomes worse in arrangement when it is advanced to the stacking place.

The foregoing has briefly described a single example of conventional stacking machines and problems associated therewith. Further examples may be had by reference to the following U.S. Pat. Nos.: 3,772,971; 2,274,075; 3,542,362; 3,683,758; 3,727,780; 3,550,493; 2,947,428; 3,297,174; and 3,373,666 which illustrate various approaches to the problem of stacking continuously flowing streams of articles, Although not necessarily corrugated paperboard blanks, and which are believed to reasonably represent the current state of the art.

Accordingly, an object of the present invention is to improve the methods and apparatus used for stacking continuously advancing streams of paperboard blanks and particularly to improve the quality of the stacks of blanks formed by such apparatus.

SUMMARY OF THE INVENTION

According to the invention, an upper shingling conveyor assembly receives blanks discharged from the upper cut-off knife. The conveyor assembly includes an endless motor-driven upper conveyor belt. Situated as an extension thereof is a second conveyor belt which is driven by the same above described motor. There is a separate motor-driven lower endless shingling conveyor assembly. Each motor is regulated by way of a tachometer-generator so that all the conveyors run at a linear speed less than the supply conveyors associated with the cut-off knives. The input ends of the shingling conveyors are provided with brushes which extend across the whole width of the conveyors to control falling of the blanks from the supply conveyors. Photo-cells are placed on either side of each conveyor to control the falling distance of the blanks onto the shingling conveyors. Photo-cells are also placed, with the help of switches and hydraulic lifting-machines, in such a way as to provide for removal of vertical stacks of blanks from the stacking platforms. The arrangement assures a constant minimal fall-height of blanks from the shingling conveyors to the stacking platforms. Switches and magnetic couplings are used between the first and second upper conveyor belts. These function to stop the second conveyor belt and provide a storage stack thereon during removal of the formed stack from the stacking platform. A gate assembly at the downstream ends of the upper and lower conveyor assemblies includes a roll that is preferably covered with polyurethane plastic and that works together with a roll that is activated by a limit switch which signals that the desired stack height has been reached. Stacking platforms beneath the ends of the upper second and lower conveyor assemblies receive the blanks from the conveyors.

The above and further objects and novel features of the invention will appear more fully from the following detailed description when the same is read in connection with the accompanying drawings. It is to be expressly understood, however, that the drawings are not intended as a definition of the invention but are for the purpose of illustration only.

BRIEF DESCRIPTION OF THE DRAWINGS

In the drawings wherein like parts are marked alike.

DESCRIPTION OF THE PREFERRED EMBODIMENT

Figure 1:
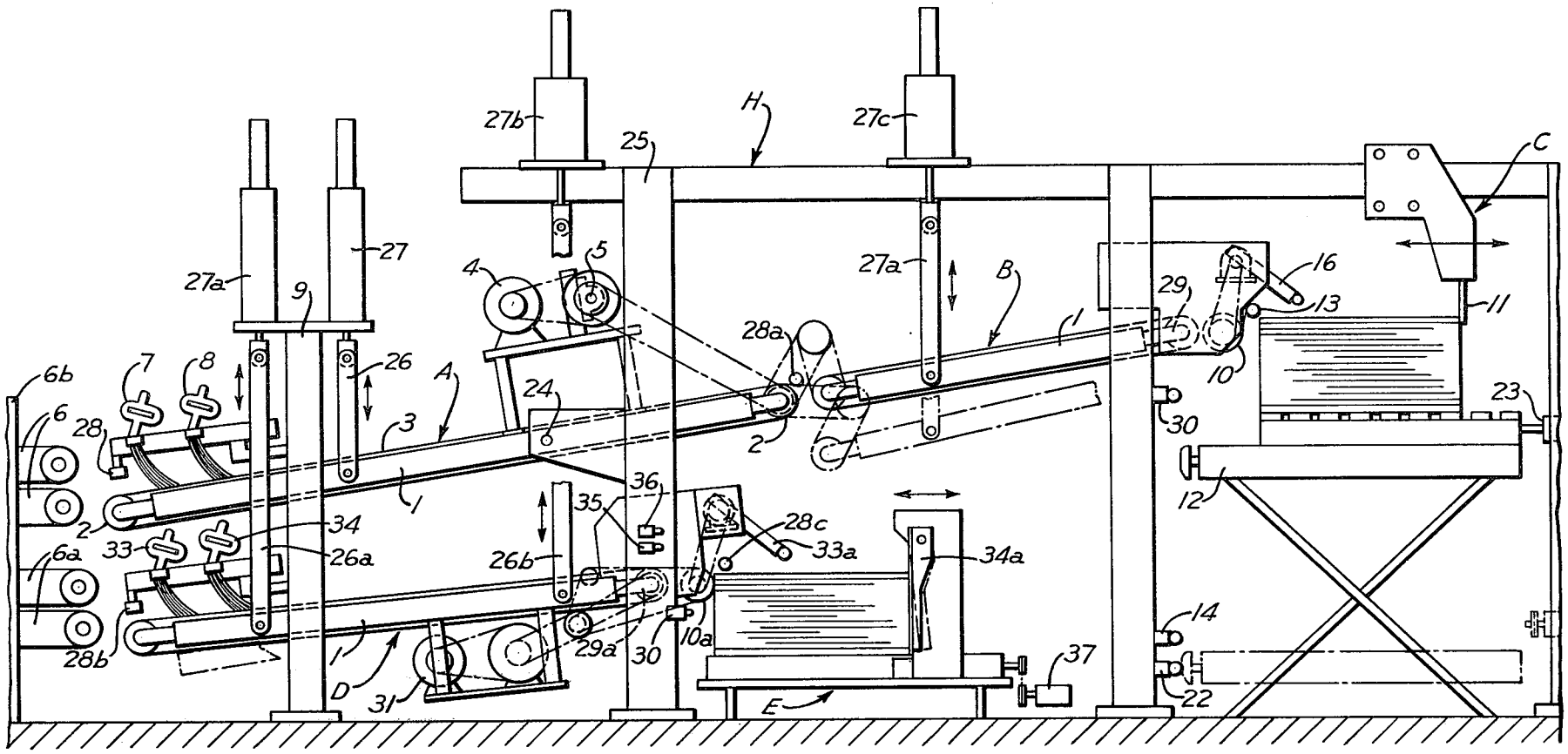
FIG. 1 is a schematic illustration of the invention in side elevation showing the supply conveyors at the end of a cut-off knife and the general arrangement of the shingling conveyors and stacking platforms.

The upper stacking station consists mainly of a conveyor assembly that is formed by a first upper conveyor assembly A, a second upper conveyor assembly B, and a stacking platform C.

The conveyor assembly A has a width which is equal to that of the corrugator machine and includes a pair of spaced pulleys 2 supported by a support table 1, the pulleys being encircled by a pair of side by side endless conveyor belts 3 which are of such width as to cover together the full width of the table. An adjustable speed motor 4 drives the belts 3 by means of a conventional chain drive assembly 5. The speed of the motor 4 and therefore the speed of the conveyor belts 3 are regulated by a conventional tachometer-generator (not shown) driven by the corrugator machine 6b. In principle, the system is connected in such a way that the linear speed of the conveyors A and B is about ⅓ the speed of the oncoming blanks from the supply conveyors 6 and 6a. This results in overlapping (called shingling) of the blanks on the conveyors A and B. The tachometer-generator system operates such that, when the corrugator machine runs faster or slower, the conveyors A and B likewise run faster or slower so that the linear speed thereof remains proportional to the speed of the supply of blanks from conveyors 6 and 6a.

During normal stacking on the stacking platform C, the blanks coming from the supply conveyors 6 are put down on the conveyor A in an overlapped or shingled fashion as determined by the lineal speed of conveyor A. A linear speed rate proportion of 1:3 gives an overlap of 66-⅔% of the length of the blanks on conveyor A.

Two brush assemblies 7 and 8 extend as shown over the entire width of conveyor A. The brush-holders are fastened to a supporting column 9. The brush 7 is not adjustable while brush 8 is adjustable lengthwise as well as parallel to the conveyor A. Both brushes can be pivoted to increase or to decrease the compression of the brush on the blanks.

At the end of the conveyor A, the blanks are still overlapped as they pass onto the second conveyor B. During normal stacking on the stacking platform C, the conveyor B is positioned in vertical alignment with conveyor A. The conveyor B is constructed similar to that of conveyor A except that it also includes a roll 10 that is covered with polyurethane plastic that will be described later in detail. Conveyor B is driven by conveyor A by a conventional system of chain sprockets and chains, a magnetic coupling and a scissor-mechanism to be described later in greater detail. The blanks are deposited over the upper-side of roll 10 onto the already formed stack. The roll 10 has the same linear output speed as the conveyors A and B and acts as the last part of the machine to move the blanks against a striker plate 11.

The striker plate 11 forms a part of stacking platform C. Stacking platform C consists of a cage assembly as shown in FIG. 1 with a hydraulic lift-table 12 inside. The lift-table 12 lowers or falls an amount corresponding to the blanks being deposited thereon to maintain a constant fall space between the end of conveyor B and the top of the stack. The photo-cell 13 is sensitive to the top of the stack and causes the table 12 to fall by means of suitable controls (not shown), an amount corresponding to the thickness of the blank that activates the photo-cell. The striker 11 is adjustable lengthwise to accommodate various blank lengths produced by the corrugator. The striker 11 is not only adjustable but can also be adjusted ahead of time. During production of a particular blank-length one can, by way of micro-switches (not shown), preadjust its position for the next length of blanks to be produced.

The blanks should be stacked precisely above each other on table 12. Maintaining the fall height of the blanks from roll 10 to the top of the stack helps to achieve precise alignment. This fall-height can be reached by a precise installation of the photo-cell 13.

After the stack on the stacking platform C has reached a height of about 2000 mm, the stack must be transported sideways. However, the corrugator production cannot be interrupted.

Figure 2:
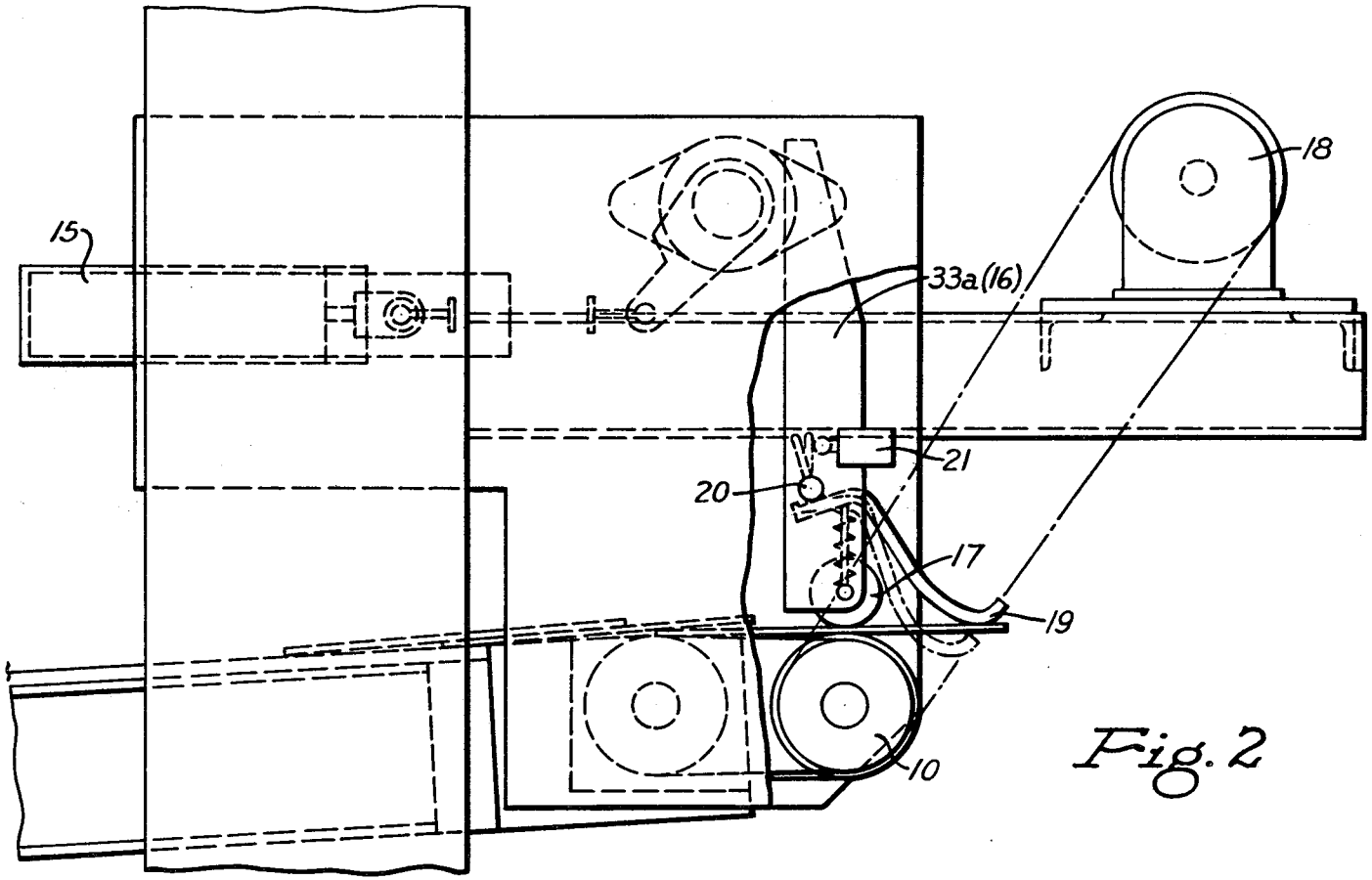
FIG. 2 is a schematic illustration in side elevation of the gate assembly at the downstream or output ends of the shingling conveyors used to interrupt the flow of blanks and expel the blanks lying between the rolls of the gate assembly prior to removal of a stack from the stacking platform.

The maximum height of the stacks will be reached when the table 12 has almost reached its lower stand, or place. In this way, the micro-switch 14 will be pushed in, and a signal is given to the air-cylinder 15 (see FIG. 2) whereby the gate assembly 16 (which is open in normal circumstances about 70°) is moved into a vertical (closed) position. This gate extends over the full width of the machine. The gate assembly includes an upper roll 17 which extends over the whole width of the machine. The roll 17 is located, when the gate assembly is actuated to interrupt the flow of blanks, right above roll 10. Since the gate assembly 16 is regulated via the switch 14, then while the gate is closed some of the blanks will be held in engagement between the roll 17 and the roll 10, in an overlapping manner. At the same moment that switch 14 is activated and the gate 16 closes, a signal is provided to an electric clutch (not shown) associated with drive motor 4 to bring conveyor B to a standstill. This standstill will be described later because it is important that the supply of blanks to the platform 12 be interrupted during removal of the stack from the platform.

The blanks held between roll 17 and roll 10 still have to be expelled as fast as possible so that removal of the stack can take place in the shortest period of time. The roll 10, which normally is driven on by way of chains and sprockets from the pulley 29 of conveyor B, is now driven by an extra motor 18. For that purpose there is attached to roll 10 a system of commonly known free-wheeling couplings.

In this manner, the last blanks between rolls 10 and 17 will be deposited on the stack. In order to make automatic operation possible, there is a pivot 20 connected to an alignment (touch) plate 19. Plate 19 turns around the pivot 20 and is supported by its own weight. As soon as the last blanks pass the alignment plate 19, the plate falls automatically until the switch 21, which in turn is connected to pivot 20, is turned on. The signal of this last switch 21 causes the platform 12 to lower down further until the switch 22 is activated. At this point the platform cannot be lowered down any further. The difference in height between switches 14 and 22 is required in order to make room for the stack to be removed sideways. This also prevents misalignment of the stack from friction during removal. The switch 22 not only stops the hydraulic system from lowering the platform any further, but also acts as a signalling device for starting the removal rolls on platform 12 by activating motor 23 which drives the rolls. With a circular speed of about 20 m/min. the stack will be automatically removed sideways to a conveyor (not shown) which does not belong to the invention.

There are other provisions in order to continue the stream of blanks, including the removal of stacks, when the conveyor B comes to a standstill; for example, the conveyor A runs considerably slower. By installing an automatic control system, the slow down can be varied from O to maximum machine speed. The control system is desirable in order to meet the varying needs of different customers. Since the corrugator runs at its original production speed and since the conveyor A runs considerably slower, then the degree of overlapping of the blanks on the up-stream end of conveyor A will be relatively increased. Through this, conveyor A becomes a temporary storage magazine. However, the increased overlap of the blanks increases the thickness of the layer of blanks on the conveyor A so that the conveyor A has to be slowly lowered in order to maintain the constant fall-height from the supply conveyors 6. Therefore conveyor A is pivotally supported on pivot 24 that is attached to the column 25. A pull-mechanism 26 hangs on either side of the support table 1. The pull-mechanisms are in turn connected to (piston) bars of matching hydraulic cylinders 27. On the upstream end of the conveyor A, a photo-cell 28 is placed. Upon slowing down of the conveyor A, the layer of blanks grows thicker. The photo-cell 28 reacts and as a result the matching cylinders 27 will lower until the blanks are again free of the photo-cell's lightbeam.

Since the conveyor A runs slower, the blanks will be delivered to the stopped conveyor B. By a similar arrangement of piston 27*a* and cylinder 27*c* the upstream end of the conveyor B is lowered in order to store the stack growing thereon. The conveyor B is also pivotally supported on a pivot 29. The upward stream end of the conveyor B also becomes temporary storage place for the blanks and, as a result, a storage stack of blanks is formed thereon.

As mentioned before, both of the conveyors A and B are driven by a common motor 4; however, during the removal of the stack from platform 12, the conveyor B stands still. Also, the upstream end of conveyor B lowers with respect to the down stream end of conveyor A. This is possible by using the chain sprockets, chains, magnetic couplings and scissor mechanisms of well known construction and operation.

After a complete stack of blanks is removed from the stacking platform C sideways to the outside, a photo-cell (not shown) senses the removal and causes platform 12 to return to an up position. The upward movement of the platform is stopped by a switch 30 and the platform is ready once more to receive the blanks. The switch 30 is not only workable for stopping the table at its highest point, but also provides a signal by which the gate assembly 16 is again placed in its open position. At the same time the motor 4 is controlled to bring the conveyors A and B back to their original speed. It all does not happen suddenly but with a relative small speed up motion. Thus, care is taken to keep the blanks lying on the conveyors in the right position whereby the stack on the platform 12 is formed in precise alignment.

Shortly after the conveyors A and B are running at their normal speed and the temporary storage of the blanks is taken up on the upstream parts of A and B, switch 30 and photo-cell 28 causes the conveyors A and B to be raised to their normal places.

Figure 3:
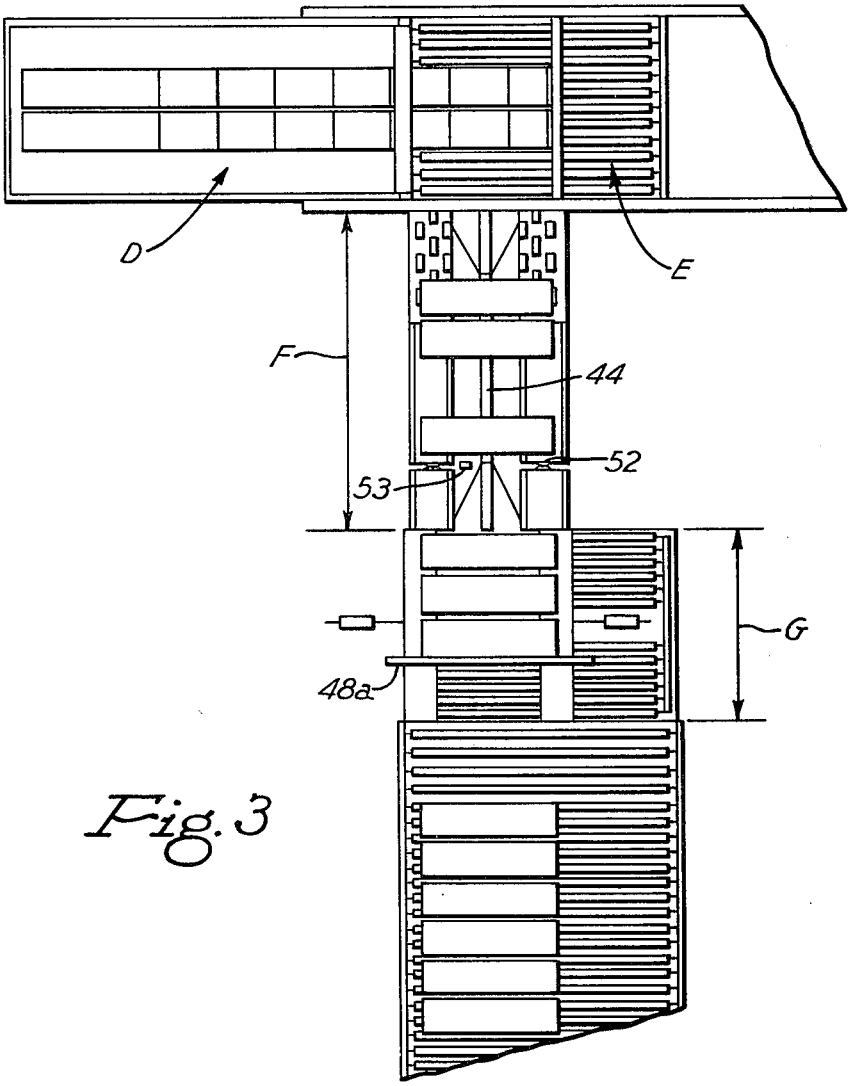
FIG. 3 is a schematic illustration in top plan view showing the lower stacking platform and the laterally adjacent accumulator station for forming final stacks.

The main elements of the lower stacking station consists of a conveyor D, a stacking platform E, a separator station F, and an accumulator station G (see FIG. 1 and FIG. 3).

The conveyor D has a width that is even with that of the corrugator machine, as was described before with relation to the conveyors A and B. It includes a similar support table 1 with pulleys over which run two endless belts. An adjustable speed motor 31, which hangs on the support table 1, drives the conveyor D. The same tachometer-generator mentioned above, also regulates the speed of conveyor D. Conveyor D also runs at a maximum speed of ⅓ of the linear speed of the blanks received from supply conveyors 6*a*.

During normal stacking on stacking platform E, the blanks are deposited from the supply conveyors 6*a* onto the conveyor D in an overlapping manner. There are also brushes 33 and 34 over the full width of the conveyor D. The construction and operation of these brushes are the same as those described before.

To finally obtain precise stacks on the stacking platform E, the fall-height from the conveyor D to the platform E should be as small as possible. For that purpose, the conveyor D hangs on the furthest end of a hydraulic cylinder system 27*b* and pull-mechanism 26*b* while a photo-cell 28*c* controls the cylinder system 27*b* to raise conveyor D as the top of the stack on platform E rises.

When the stack has reached its maximum height of about 300 mm. on the platform E, a gate assembly 33*a* closes. This gate is practically the same as the gate 16 on the end of the conveyor B. Likewise, there is found on the downstream end of conveyor D a covered roll 10a which works the same way as the roll 10 of conveyor B. In all other respects, conveyor D is like conveyor B.

When the blanks on conveyor D are delivered onto the stacking platform E, they will lie lengthwise against the striker plate 34*a*. The operation of striker plate 34*a* is much the same as for striker 11. The striker 34*a* is not only adjustable but also preadjustable or presettable.

On the moment that the gate 33*a* closes, the conveyor D comes to a standstill. The corrugator machine continues to deposit blanks upon conveyor D, which also includes a system of hydraulic cylinders and pull devices.

This means that the conveyor D, in front and in back, includes a whole system of hydraulic cylinders and pulling mechanisms (27*a* – 27*b* – 26*a* – 26*b*). The photo-cell 28*b* provides a signal for the hydraulic cylinders 27*a* to lower the input end of conveyor D until the blanks deposited thereon are again totally free of the lightbeam of photo-cell 28*b*. Thus, the first part of the conveyor D consequently works as a temporary storage place for the blanks.

As soon as the gate assembly 33*a* deposits the last blanks on the stack, then the end of conveyor D is raised slightly higher so as not to interfere with removal of the stack from platform E. For this purpose there is a system that consists of two switches 35 and 36 whose main function is the same as already described for switches 14 and 22, but in an opposite direction.

It should be observed that on conveyor D as well as on conveyor A and B, side by side flows or streams of blanks can run next to each other, so that on the stacking platforms, several stacks can also be formed next to each other in a cross machine direction.

Figure 4:
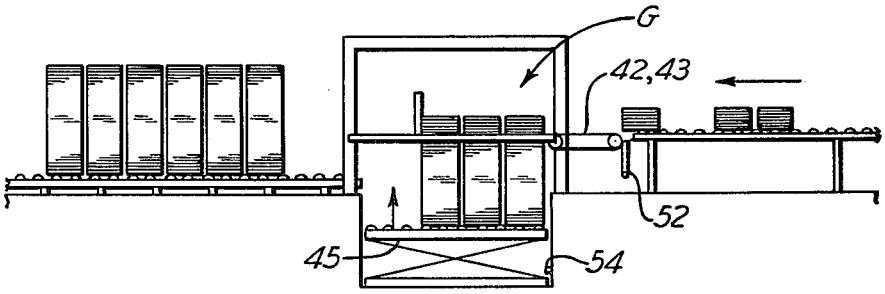
FIG. 4 is a side-view of the apparatus of FIG. 3.
Figure 7:
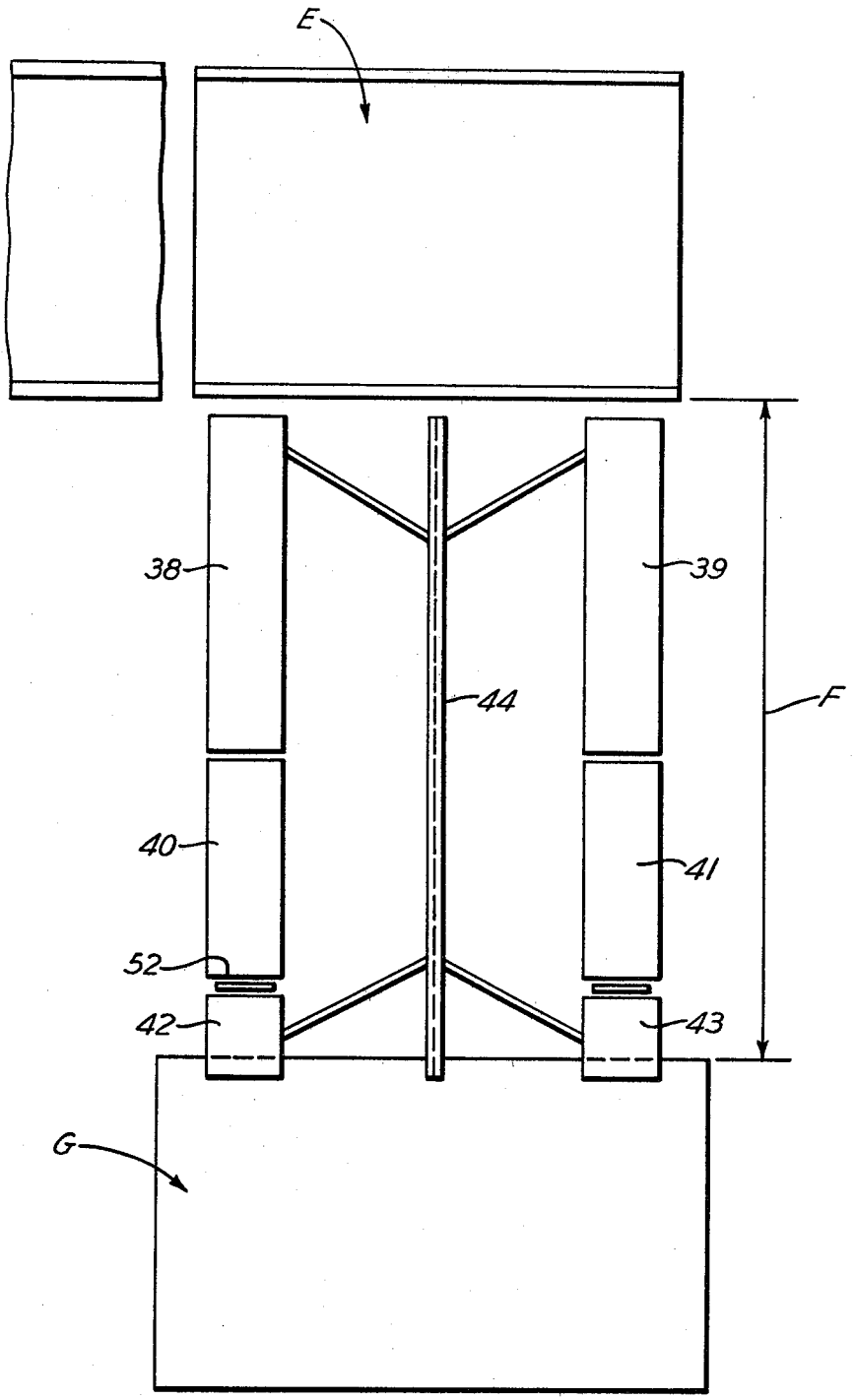
FIG. 7 is a top view of an accumulator conveyor assembly between the lower stacking platform and the accumulator station.

After the output end of conveyor D has reached its highest point, the switch 36 gives a signal to the motor 37 for driving the rolls of the stacking platform E to remove the stack. The motor 37 starts slowly in order to prevent the misalignment of the stack which could result if the start should be sudden. All stacks formed on stacking platform E are carried off sideways to separator transport mechanism shown in FIGS. 4 and 7.

The separator mechanism consists mainly of a left part (38, 40, 42) and a right part (39, 41, 43). The left part stays continuously in its place, while the right part is adjustable from left to right, depending upon the length of the stacks of blanks removed from the stacking platform E. In order to support long blanks, there is a center guide rail 44. This rail always stays in the middle no matter how far or near the parts 38–40 and 39–41 are pushed from each other. The parts 38 and 39 are non-driven conveyor wheels which run slightly downwards so that the stacks coming from the platform E run automatically to the lower point of this transportation mechanism. The parts 40 and 41 are driven by conveyor belts. They have about a 3½% upward slant and bring the stack of blanks to the end of the belts. Parts 42 and 43 (see also FIG. 5) are also driven by conveyor belts but at a speed that carries about double that of belts 40 and 41. When the consecutive stacks from platform E are taken over by the belts 42 and 43, then the stacks are thereby taken apart. In other words, there will be a space created between the stacks to thereby form discrete stacks of blanks. The parts 42 and 43 deliver the stacks at this point, to accumulator station G more particularly shown in FIGS. 5 and 6.

In accumulator station G, different stacks can be formed beside each other on a hydraulic moveable lift table 45 which is standing in a hole. The upper blade is provided with conveyor wheels for the transport of the already formed stacks. The upper blade of this hydraulic lift table is indicated by 45. On the upper blade there is already present a stack of ready made blanks. The stacks of blanks which are being delivered by the parts 42 and 43 from the separator mechanism are being pushed further into movable plates 46 and 47, which in turn are provided with a number of tiny rolls to ease the work of transporting the stacks.

As soon as the number of stacks are in their place on the blades 46 and 47, the blades will be pulled to the outside by way of a pneumatic-servo mechanism. Then the stacks lying on the blades are released onto the already formed stacks on the hydraulic lift table 45. The accumulator G offers many other benefits which will be described later in detail. Besides the already mentioned hydraulic lift table 45, the accumulator station consists of an open cage-like construction 48. On the left as well as the right side is found a construction for the receiving of the oncoming stacks. The apparatus on the left side is permanently attached, while the one on the right side is totally movable all along the construction, to be adjusted according to the length of the oncoming stack (see size L, FIG. 6). The adjustment of length-L takes place totally automatically. And as already described, the striker plate 34*a* of the stacking platform E is adjustable and presettable. When the striker plate 34*a*, after an order exchange, has come to a new place, then the striker plate 48*a* is activated via a photo-cell. The striker assumes a new position according to the length of the blanks. Depending on the width of the oncoming stacks, and depending on the maximum depth of the stacking station (size M, FIG. 5), the number of stacks can now be chosen to be formed next to each other on the hydraulic lift-table. Naturally, in order to have the stacks held up at a particular point, a uniform movement must be present. This uniform movement is provided by a movable plate 48*a*. At the beginning, this plate 48*a* is moved to the end of size M in its ultimate position and the other time is moved to the end of size M′ in the chosen position. An example is given of the size M-3 stacks next to each other.

Figure 6:
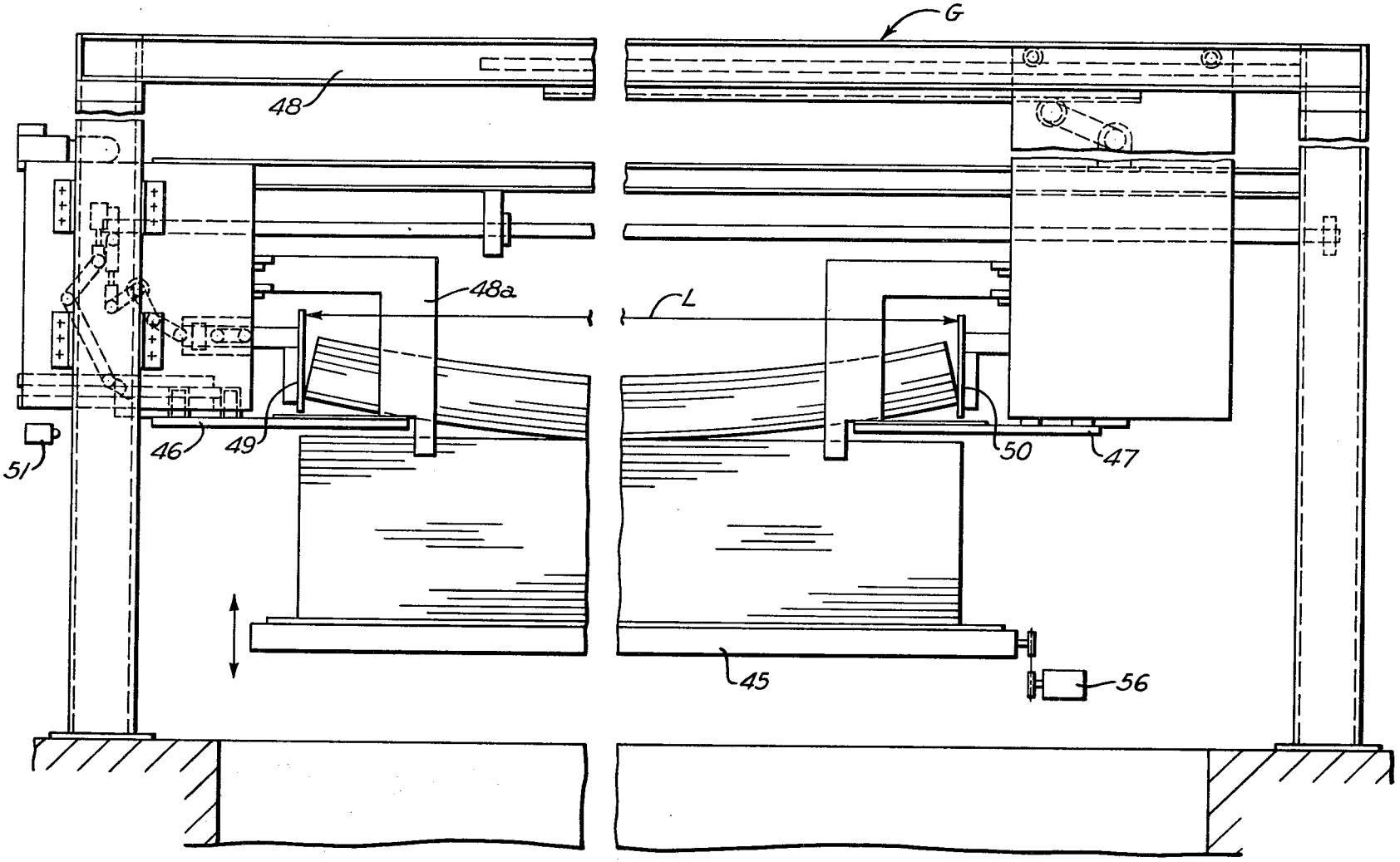
FIG. 6 is a front-view of the construction of FIG. 5.

With the blades 46 and 47 standing in their extended position and with the separator mechanism F supplying 3 stacks, then those three stacks are first pulled apart slightly by belts 42 and 43 and then pushed consecutively on the blades 46 and 47 until they reach the plate 48*a*. When the stacks are pushed on the blades 46 and 47, the stacks are not led sideways. The blades 49 and 50 give the stacks on both sides a room of about 100 mm. When the stacks have arrived at their right places, the blades 49 and 50 are used for correcting irregularities in the stacks. The striker blades 49 and 50 are connected to pneumatic cylinders. Those blades 49 and 50 are forced to take the striker length L, whereby the last straightening out of the blanks takes place. In FIG. 6, the plates 49 and 50 are shown standing in outward position.

After straightening the stack, the blades 46 and 47 are pulled back, whereby the stacks make a soft landing on the already formed stacks of the hydraulic lift table 45. The plates 49 and 50 are simultaneously pulled back in position. The hydraulic lift table lowers in order to make possible the complete circle of events. This takes place by way of a photo-cell 57 which assures that the hydraulic lift table cannot fall any further than the height of the oncoming stack. After the table is lowered sufficiently, the hydraulic system comes to a standstill via a signal from the photo-cell 57, which in turn also sends a signal to the pneumatic system of plates 46 and 47 to spread them for the next stack. The unit is then ready for taking up a number of stacks.

In principle, it is possible to have three consecutive stacks on the separator transport mechanism at one time. There is a possibility that the separator transport mechanism may try to bring a fourth stack onto the blades 46 and 47 while these are already filled. To prevent this, there are vertically movable fingers brought between the conveyors 40 and 42 and 41 and 43. An electronic counter (not shown) which in the present example is tuned in to a total number 3. After three stacks are deposited on the plates 46 and 47, a signal is given by the counter to a pneumatic system for the vertically movable fingers 52. These rise to hold up temporarily the oncoming stacks. Only after the lift table is lowered and the blades 46 and 47 are again extended will the fingers 52 go down and to give the following stacks the freedom to be deposited on the blades 46 and 47.

Figure 5:
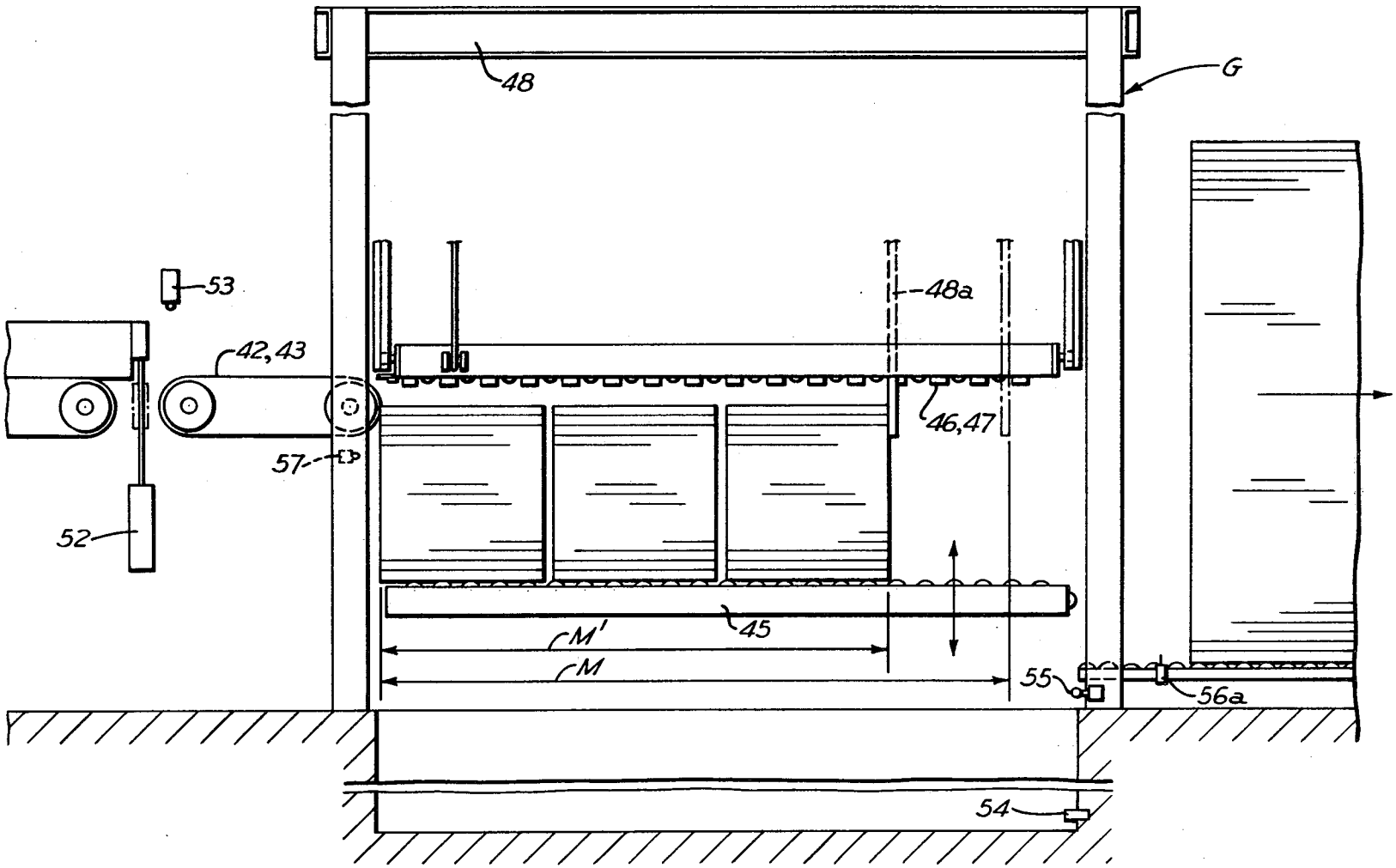
FIG. 5 is an enlarged view of the center portion of FIG. 4 showing the apparatus for forming final stacks from smaller stacks coming from the lower stacking station shown in FIG. 1.

It should be observed that the front and back sides of the stacks are straightened out during the lowering of the lift table, the total width of all three stacks are being forced to take on the size M, which is defined by the striker plates 48*a* and the conveyor belts 42 and 43 as shown in FIG. 5.

It also becomes clear why the speed of the conveyor belts 42 and 43 run faster than that of the speed of belts 40 and 41. The stacks have to be pulled apart to make room for the rising movement of the fingers 52. At this point the photo-cell 53 also triggers the electronic counter. As more stacks are deposited on the table 45, the table lowers until it is almost in its lowest position. This is the maximum stack height on table 45. This lowest position is perceived (regulated) by a switch 54. The final stack now has to be brought outwards since the hydraulic lift table is standing in the hole, and has to be brought to groundlevel. Of course, during the final stack removal, the fingers 52 stay up, since the machine during the stack removal is unable to pick up new stacks.

The raising of the lift table for the removal of the final stacks takes place automatically. The switch 54 provides a signal for raising the lift table; reaching of the correct height for removal is regulated by a switch 55, which also takes care of stopping the lift table. The switch 55 also gives a signal to the driving motor 56 of the rolls of the lift table. However, before turning the rolls original the lift table to remove the stack of the outside, the striker plates 48*a* have to be removed. These are controlled by a switch 54 which is the same switch that signals the lift table to be raised. After the stacks are brought to the outside, which is regulated by a switch 56*a*, the lift table is raised to its highest position. The highest position of the lift table is defined by a switch 57. The switch 56*a* also gives a signal to the striker plates 48*a* to return to their orginal point and at the same time gives a signal to the plates 46 and 47 to extend. The machine is then ready for a totally new cycle.

It will take some time, naturally, to complete the whole cycle and to bring it to the original position. This explains the need for the separator mechanism F described above. The length of the separator is such that two full loads of stacks from stacking station E can be taken up, so as to shorten the time of the stack removal taking place in the accumulator station G.

Having thus described the invention in its best embodiment and mode of operation, that which is desired to be claimed by Letters Patent is:

1. Apparatus for forming first and second stacks of blanks from vertically displaced, parallel streams of said blanks comprising:

a first stacking station for stacking the blanks from a first of said streams, said first stacking station including:

a first conveyor means in alignment with said first stream for advancing, in shingled fashion, the blanks from said first stream;

first platform means beneath an output end of said first conveyor means for receiving said blanks in stacked formation thereon; and first gate means adjacent said output end of the first conveyor means for interrupting the advance of said blanks thereon when the height of said first stack reaches a predetermined height on said first platform means; and a second stacking station for stacking the blanks from a second of said streams, said second stacking station including:

a second conveyor means in alignment with said second stream for advancing, in shingled fashion, the blanks from said second stream;

second platform means, downstream from said first platform means, beneath an output end of said second conveyor means for receiving said blanks in stacked formation thereon; and second gate means adjacent said output end of the second conveyor means for interrupting the advance of said blanks thereon when the height of said second stack reaches a predetermined height on said second platform means, said output end of the first conveyor means being upwardly movable in proportion to an increase in height of said first stack for maintaining a substantially constant fall space between said output end and the top of said first stack, said second platform means being downwardly movable in proportion to an increase in height of said second stack for maintaining a substantially constant fall space between the output end of said second conveyor means and the top of said second stack; and switch means for stopping said first and second conveyor means upon respective activation of said first and second gate means, each of said conveyor means having an input end movable downwardly relative to said first and second streams for accumulating a storage stack of blanks thereon from said first and second streams respectively while said conveyor means are stopped, each of said first and second gate means including:

first and second roller means between which said blanks pass from the respective conveyor means to the respective platform means, said second roller means movable into engagement with said blanks upon activation of said gate means; and control means for rotating said second roller means after engagement thereof with said blanks to advance blanks then between said first and second rollers onto said stacks on the respective platform means prior to removal thereof from said stacking stations.

2. The apparatus of claim 1 wherein each of said first and second conveyor means includes:

laterally extending brush means engageable with the top of said blanks entering the respective conveyor means from said first and second streams for controlling the entry of said blanks onto said first and second conveyor means.

3. The apparatus of claim 2 wherein said second conveyor means includes:

a primary conveyor means for advancing blanks from said second stream to said second platform means; and a secondary conveyor means preceding said primary conveyor means for advancing said blanks from said second stream to said primary conveyor means, an input end of said primary conveyor means falling relative to an output end of said secondary conveyor means for accumulating a stack of blanks on said input end while said primary conveyor means is stopped.

4. The apparatus for claim 3 further including:

a removal means associated with each of said platform means operative, following activation of the respective gate means, for removing said stacks from the respective platform means in a direction transverse to the advance of said blanks along said first and second conveyor means.

5. The apparatus of claim 4 further including:

an accumulator station laterally aligned with said first stacking station for forming final stacks of blanks from stacks of blanks removed from said first stacking station, said accumulator station having:

a separator conveyor means for lineally separating said stacks into spaced discrete stacks;

a support means adjacent an output end of said separator conveyor means for receiving and momentarily holding consecutive ones of said discrete stacks;

an accumulator platform means beneath said support means for receiving consecutive ones of said discrete stacks released by said support means one on top of another; and control means for lowering said accumulator platform means a distance corresponding substantially to the height of each of said discrete stacks following release of each consecutive discrete stack thereon by said support means, whereby final stacks of blanks are formed on said accumulator platform means from consecutive ones of said discrete stacks.

6. The apparatus of claim 5 wherein said support means includes adjustment means for enabling said support means to receive a plurality of said discrete stacks in serial alignment and to simultaneously release the same onto said accumulator platform means for concurrently forming a plurality of said final stacks.

* * * * *